United States Patent [19]

Sung

[11] Patent Number: 4,981,493

[45] Date of Patent: Jan. 1, 1991

[54] ORI-INHIBITED AND DEPOSIT-RESISTANT MOTOR FUEL COMPOSITION

[75] Inventor: Rodney Lu-Dai Sung, Fishkill, N.Y.

[73] Assignee: Texaco Inc., White Plains, N.Y.

[21] Appl. No.: 302,493

[22] Filed: Jan. 27, 1989

[51] Int. Cl.[5] ..... C10L 1/22

[52] U.S. Cl. ..... 44/331; 528/341; 564/505

[58] Field of Search ..... 44/63, 62, 71, 72; 525/409; 528/341; 548/544, 546, 547; 564/505

[56] References Cited

U.S. PATENT DOCUMENTS

| | | | |
|---|---|---|---|
| 3,897,351 | 7/1975 | Davis et al. | 252/49.3 |
| 4,198,306 | 4/1980 | Lewis | 44/63 |
| 4,240,803 | 12/1980 | Andress, Jr. | 44/63 |
| 4,257,779 | 3/1981 | Sung et al. | 44/63 |
| 4,282,008 | 8/1981 | Sung | 44/63 |
| 4,422,856 | 12/1983 | Maldonado et al. | 44/63 |
| 4,536,189 | 8/1985 | Sung | 44/63 |
| 4,643,737 | 2/1987 | Sung et al. | 44/63 |
| 4,652,273 | 3/1987 | Maldonado et al. | 44/63 |
| 4,747,851 | 5/1988 | Sung et al. | 44/72 |

*Primary Examiner*—Margaret B. Medley

*Attorney, Agent, or Firm*—Robert A. Kulason; James J. O'Loughlin

[57] ABSTRACT

A motor fuel composition which inhibits engine ORI and resists engine deposit formation comprises a mixture of hydrocarbons boiling in the range of 90° F.–450° F. and the reaction product of a dibasic acid anhydride, a polyoxyalkylene polyol, and a nitrogen-containing compound selected from the group consisting of: (i) a $C_2$–$C_8$ polyalkylene polyamine, (ii) a polyoxyalkylene diamine, and (iii) a heterocyclic azole.

25 Claims, No Drawings

ORI-INHIBITED AND DEPOSIT-RESISTANT MOTOR FUEL COMPOSITION

BACKGROUND OF THE INVENTION

1. Field of the Invention

This invention relates to an ORI-inhibited and deposit-resistant motor fuel composition. More particularly, this invention relates to a motor fuel composition comprising a reaction product obtained by reacting a dibasic acid anhydride, a polyoxyalkylene polyol, and a nitrogen-containing compound selected from the group consisting of: (i) a $C_2$–$C_8$ polyalkylene polyamine, (ii) a polyoxyalkylene diamine, and (iii) a heterocyclic azole.

2. Information Disclosure Statement

Co-assigned U.S. patent appl. Ser. No. 07302,494, filed Jan 27, 1987 discloses a haze, oxidation and corrosion-resistant diesel engine lubricant composition comprising a major amount of a hydrocarbon lubricating oil and a minor amount of the reaction product of a dibasic acid anhydride, a polyoxyalkylene diamine, and a heterocyclic azole.

Co-assigned U.S. patent appl. Ser. No. 4,865,622, discloses an ORI-inhibited and deposit-resistant motor fuel composition comprising reaction product obtained by reacting a dibasic acid anhydride, a polyoxyalkylene diamine, and a heterocyclic azole.

Co-assigned U.S. Pat. No. 4,758,363 (Sung et al.) discloses an oxidation and corrosion resistant diesel engine lubricant comprising an additive which is the reaction product of a hydroxybenzoic acid, a polyoxyalkylene polyol, an aldehyde or ketone, and a heterocyclic azole.

Co-assigned U.S. Pat. No. 4,758,247 (Sung) discloses an ORI-inhibited motor fuel composition comprising an additive which is the reaction product of a polyoxyalkylene polyol and an n-acyl sarcosine.

Co-assigned U.S. Pat. No. 4,643,737 (Sung et al.) discloses a motor fuel composition comprising an additive which is the reaction product of maleic anhydride, a polyoxyalkylene polyol, and an n-alkyl-alkylene diamine.

Co-assigned U.S. Pat. No. 4,548,616 (Sung et al.) discloses an ORI-inhibited motor fuel composition comprising an additive which is a polyoxyalkylene polyol.

Co-assigned. U.S. Pat. No. 4,444,566 (Crawford et al.) discloses a motor fuel composition comprising an additive which is a polyoxyalkylene diamine of the formula $$NH_2-\underset{\underset{CH_3}{|}}{CH}-CH_2-[O\underset{\underset{CH_3}{|}}{CHCH_2}]_x-[OCH_2CH_2]_y-[O\underset{\underset{CH_3}{|}}{CHCH_2}]_z-NH_2$$

where x and z each have an approximate value ranging from 1–3, the sum of x+z has an average value of 3–4, and y has an approximate value of 10–16.

U.S. Pat. No. 4,425,248 (Piotrowski et al.) discloses a water soluble lubricant composition comprising an alkanolamine and a partial acid amide of a dicarboxylic acid.

Co-assigned U.S. Pat. No. 4,332,595 (Herbstman et al.) discloses a detergent additive for use in motor fuel compositions which may be represented by the formula $$R-[OCH_2-CH-(CH_3)]_y-NH-(CH_2)_3-NH_2$$

where R is a $C_8$–$C_{18}$ hydrocarbyl radical and y has a value of about 2–6.

U.S. Pat. No. 4,198,306 (Lewis) discloses the use of hydrocarbyl poly (oxyalkylene) aminoesters which are monoesters of a hydrocarbyl-terminated poly (oxyalkylene) alcohol and a monocarboxylic $C_2$–$C_{20}$ (amino-substituted) alkanoic acid as an ORI-controlling additive in motor fuel compositions.

SUMMARY OF THE INVENTION

According to this invention, an ORI-inhibited and deposit-resistant motor fuel composition comprises a mixture of hydrocarbons boiling in the range from about 90°–450° F. and additionally comprises from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene polyol of the formula $$OH-(CH_2CH_2O)_x-(\underset{\underset{CH_3}{|}}{CHCH_2O})_y-(CH_2CH_2O)_z-H$$

where x+z has a value in the range of 1–20, and y has a value in the range of 5–100; and (c) 0.5–1.5 moles of a nitrogen-containing compound selected from the group consisting of:

(i) a $C_2$–$C_8$ polyalkylene polyamine;

(ii) a polyoxyalkylene diamine of the formula $$NH_2-(R_2)_q-[O\overset{\overset{CH_2CH_3}{|}}{CHCH_2}]_a-[O\underset{\underset{CH_3}{|}}{CHCH_2}]_b-[OCH_2CH_2]_c-$$

$$-[OCH_2\underset{\underset{CH_3}{|}}{CH}]_d-[OCH_2\overset{\overset{CH_2CH_3}{|}}{CH}]_e-(R_3)_r-NH_2$$

where $R_2$ and $R_3$ are $C_1$–$C_{12}$ alkylene groups, q and r are integers having a value of 0 or 1, c has a value from 2–150, b+d has a value from 2–150, and a+e has a value from 0–12; and (iii) a heterocyclic azole.

DETAILED EMBODIMENTS OF THE INVENTION

Combustion of a hydrocarbon motor fuel in an internal combustion engine generally results in the formation and accumulation of deposits on various parts of the combustion chamber as well as on the fuel intake and exhaust systems of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline powered internal combustion engines. It is usually overcome by employing a higher octane gasoline for powering the engine, and hence has become known as the engine octane requirement increase (ORI) phenomenon. It would therefore be highly advantageous if engine ORI could be substantially reduced or eliminated by preventing or modifying deposit formation in the combustion chambers of the engine.

Another problem common to internal combustion engines relates to the accumulation of deposits in the carburetor which tend to restrict the flow of air through the carburetor at idle and at low speed, resulting in an overrich fuel mixture. This condition also promotes incomplete fuel combustion and leads to rough engine idling and engine stalling. Excessive hydrocarbon and carbon monoxide exhaust emissions are also produced under these conditions. It would therefore be desirable from the standpoint of engine operability and overall air quality to provide a motor fuel composition which minimizes or overcomes the abovedescribed problems.

It is an object of this invention to provide a motor fuel composition which exhibits deposit-resistance and ORI-inhibition when employed in an internal combustion engine.

It is a feature of motor fuel compositions of the instant invention that combustion chamber deposit formation is minimized, with concomitant reduction of engine ORI.

It is an advantage that motor fuel compositions of the instant invention exhibit reduced deposit formation and engine ORI.

The ORI-inhibited and deposit-resistant motor fuel composition of the instant invention comprises a reaction product additive which is obtained by reacting a dibasic acid anhydride, a polyoxyalkylene polyol, and a nitrogen-containing compound selected from the group consisting of: (i) a $C_2$–$C_8$ polyalkylene polyamine, (ii) a polyoxyalkylene diamine, and (iii) a heterocyclic azole.

The dibasic acid anhydride reactant used to prepare the reaction product is preferably selected from the group consisting of maleic anhydride, alpha-methyl maleic anhydride, alpha-ethyl maleic anhydride, and alpha, beta-dimethyl maleic anhydride. The most preferred dibasic acid anhydride for use is maleic anhydride.

The polyoxyalkylene polyol reactant is preferably a polyol containing a block copolymer of propylene oxide and ethylene oxide moieties, the polyol having a molecular weight $M_n$ in the range of about 500–5000, preferably about 750–4000. The polyoxyalkylene polyol is of the formula:

$$OH(CH_2CH_2O)_x-(\underset{\substack{|\\ CH_3}}{CH}-CH_2O)_y-(CH_2CH_2O)_zH$$

where x+z has a value ranging from 1–20, preferably 2–5, most preferably 2.2, and y has a value ranging from 5–100, preferably 10–90.

Polyoxyalkylene polyol reactants suitable for use in preparing the reaction product additive of the instant invention include polyols such as those commercially available from the BASF Wyandotte Corporation under the PLURONIC series tradename. Examples of such polyols include those set forth below:

TABLE I

A. The BASF Wyandotte Pluronic L-31 brand of poly (oxyethylene) poly (oxypropylene) poly (oxyethylene) polyol having a molecular weight $M_n$ of 950 and containing 10 wt. % derived from poly (oxyethylene) and 90 wt. % derived from poly (oxypropylene). In this polyol, y is 14.7 and x+z is 2.2.

B. The BASF Wyandotte Pluronic L-63 brand of poly (oxyethylene) poly (oxypropylene) poly (oxyethylene) polyol having a molecular weight $M_n$ of 1750 and containing 30 wt. % derived from poly (oxyethylene) and 70 wt. % derived from poly (oxypropylene). In this polyol, y is 21.1 and x+z is 11.9.

C. The BASF Wyandotte Pluronic L-62 brand of poly (oxyethylene) poly (oxypropylene) poly (oxyethylene) polyol having a molecular weight $M_n$ of 1750 and containing 20 wt. % derived from poly (oxyethylene) and 80 wt. % derived from poly (oxypropylene). In this polyol, y is 24.1 and x+z is 8.

D. The BASF Wyandotte Pluronic L-43 brand of poly (oxyethylene) poly (oxypropylene) poly (oxyethylene) polyol having a molecular weight $M_n$ 1200 and containing 30 wt. % derived from poly (oxyethylene) and 70 wt. % derived from poly (oxypropylene). In this polyol, y is 16.6 and x+z is 5.5.

E. The BASF Wyandotte Pluronic L-64 brand of poly (oxyethylene) poly (oxypropylene) poly (oxyethylene) polyol having a molecular weight $M_n$ 1750 and containing 40 wt. % derived from poly (oxyethylene) and 60 wt. % derived from poly (oxypropylene). In this polyol, y is 18.1 and x+z is 15.9.

F. The BASF Wyandotte Pluronic L-121 brand of poly (oxyethylene) poly (oxypropylene) poly (oxyethylene) polyol having a molecular weight $M_n$ 4000 and containing 10 wt. % derived from poly (oxyethylene) and 70 wt. % derived from poly (oxypropylene). In this polyol, y is 90 and x+z is 10.

The nitrogen-containing compound reactant is selected from the group consisting of: (i) a $C_2$–$C_8$ polyalkylene polyamine, (ii) a polyoxyalkylene diamine, and (iii) a heterocyclic azole. The polyalkylene polyamine reactant, if employed, is preferably selected from the group consisting of ethylene diamine (hereinafter referred to as EDA), diethylene triamine (hereafter referred to as DETA), and tetraethylene pentamine (TETTA).

The polyoxyalkylene diamine reactant used to prepare the reaction product, if employed, is a diamine of the formula $$NH_2-(R_2)_q-[O\overset{\substack{CH_2CH_3\\ |}}{C}HCH_2]_a-[O\underset{\substack{|\\ CH_3}}{C}HCH_2]_b-[OCH_2CH_2]_c-$$

$$-[OCH_2\underset{\substack{|\\ CH_3}}{C}H]_d-[OCH_2\overset{\substack{CH_2CH_3\\ |}}{C}H]_e-(R_3)_r-NH_2$$

where $R_2$ and $R_3$ are $C_1$–$C_{12}$ alkylene groups, preferably $C_2$–$C_6$ alkylene group, most preferably a propylene or butylene group, q and r are integers having a value of 0 or 1, preferably with q=1 and r=0, c has a value from about 2–150, preferably 2–50; b+d has a value from about 2–150, preferably 2–50; and a+e has a value from about 0–12, preferably 2–8. In one preferred embodiment, q=1, r=0, $R_2$ is a butylene group and the polyoxyalkylene diamine reactant is therefore of the formula

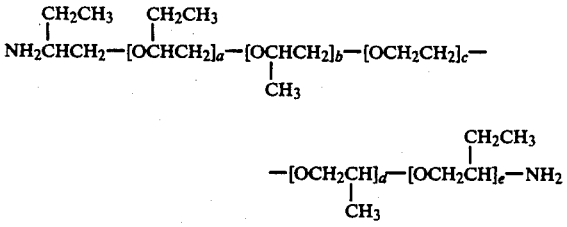

where c has a value of from 2–150, preferably 2–50, b+d has a value of from 2–150, preferably 2–50 and a+e has a value of 2–12, preferably 2–8.

In another preferred embodiment, q=1, r=0, $R_2$ is a propylene group, a+e has a value of zero, and the polyoxyalkylene diamine reactant is therefore of the formula

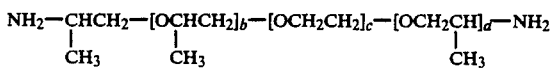

where c and b+d, respectively, have a value of from 2–150, preferably 2–50. Polyoxyalkylene diamines of the above structure suitable for use include those available from Texaco Chemical Co. under the JEFFAMINE ED-Series trade name. Specific examples of such compounds are set forth below:

| Trade Name | Approx. Value c | Approx. Value b + d | Approx. Mol. Wt. |
|---|---|---|---|
| ED-600 | 8.5 | 2.5 | 600 |
| ED-900 | 15.5 | 2.5 | 900 |
| ED-2001 | 40.5 | 2.5 | 2000 |
| ED-4000 | 86.0 | 2.5 | 4000 |
| ED-6000 | 131.5 | 2.5 | 6000 |

If the heterocyclic azole reactant is employed to prepare the reaction product, it may be any substituted or unsubstituted heterocyclic azole, but preferably is selected from the group consisting of tolyltriazole (hereinafter referred to as TTZ), benzotriazole (hereinafter referred to as BTZ), aminotriazole (hereinafter referred to as ATZ), aminotetrazole (hereinafter referred to as ATTZ), aminomercaptothiadiazole (hereinafter referred to as AMTZ), and benzomercaptothiazole (hereinafter referred to as BMTZ).

If an aminotriazole reactant is employed, it preferably will be a 3-, 4-, or 5-aminotriazole (hereinafter referred to as 3-ATZ, 4-ATZ, or 5-ATZ, respectively), including those bearing inert substituents, typified by hydrocarbon or alkoxy groups, which do not react in the instant invention. The most preferred aminotriazole reactant is 5-ATZ. If an aminotetrazole reactant is employed, it preferably will be a 4- or 5-aminotetrazole (hereinafter referred to as 4-ATTZ or 5-ATTZ, respectively), again including those bearing inert substituents, typified by hydrocarbon or alkoxy groups which do not react in the instant invention. If an aminomercaptothiadiazole reactant is employed, it preferably will be a 5-aminomercaptothiadiazole. The most preferred hydrocarbyl azole reactant for use in the instant invention is 5-ATZ.

The reaction product additive of the instant invention is prepared by first reacting 0.5–2.5 moles, preferably about 1 mole of the abovedescribed dibasic acid anhydride with 0.5–1.5 moles, preferably about 1 mole of the abovedescribed polyoxyalkylene polyol reactant, at a temperature of about 30° C.–200° C., preferably 90° C.–150° C. to produce a maleamic acid ester. The reaction is preferably carried out in the presence of a solvent. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include tetrahydrofuran, hexane, cyclohexane, benzene, toluene, and mixtures thereof. Xylene is the preferred solvent. The solvent can be present in an amount of up to about 90% by weight of the total reaction mixture. Once the reaction has been completed, the maleamic acid ester may be separated from the solvent using conventional means, or left in admixture with some or all of the solvent.

The maleamic acid ester, either alone or in solution with the abovedescribed solvent, is thereafter reacted with 0 5–1.5 moles, preferably 1 mole of the prescribed nitrogen-containing reactant at a temperature of 50°–100° C., preferably 80°–100° C. Once the reaction has been completed, the reaction product may be separated from the solvent using conventional means, or left in admixture with some or all of the solvent.

The following examples illustrate the preferred method of preparing the reaction product of the instant invention. It will be understood that the following examples are merely illustrative, and are not meant to limit the invention in any way. In the examples, all parts are parts by weight unless otherwise specified.

EXAMPLE I 49 parts of maleic anhydride, 400 ml xylene and 475 parts of a polyoxyalkylene polyol (PLURONIC L-31) were reacted at reflux temperature until all water was removed from the system to produce a maleamic acid ester. After cooling to about 60° C., 3 parts of EDA were added, and the mixture was reacted at reflux temperature until all water was removed from the system. The final reaction product was filtered and stripped of remaining solvent under vacuum, and identified by IR, NMR, and elemental analysis.

EXAMPLE II 22 parts of maleic anhydride, 918.4 parts of xylene, and 896 parts of a polyoxyalkylene polyol (PLURONIC L-121) were reacted at a temperature of about 100° C. for approximately 3 hours to produce a maleamic acid ester. The maleamic ester amide was filtered and stripped of remaining solvent under vacuum, and identified by IR, NMR and elemental analysis. Thereafter, 160 parts of a 50% active solution of xylene and the abovedescribed maleamic acid ester and 1.6 parts of 5-ATZ were reacted at a temperature of about 100° C. for approximately 2 hours to produce the final reaction product additive. The reaction product was filtered and stripped of remaining solvent under vacuum, and identified by IR, NMR and elemental analysis.

EXAMPLE III 22 parts of maleic anhydride, 918.4 parts of xylene, and 896 parts of a polyoxyalkylene polyol (PLURONIC L-121) were reacted at a temperature of about 100° C. for approximately 3 hours to produce a maleamic acid ester. The maleamic acid ester was filtered and stripped of remaining solvent under vacuum, and identified by IR and elemental analysis. Thereafter, 160 parts of a 50% active solution of xylene and the abovedescribed maleamic acid ester, and 2.4 parts of BTZ were reacted at a temperature of about 100° C. for approximately 2 hours to produce the final reaction product additive. The reaction product was filtered and stripped of remaining solvent under vacuum, and identified by IR, NMR and elemental analysis.

EXAMPLE IV 22 parts of maleic anhydride, 918.4 parts of xylene, and 896 parts of a polyoxyalkylene polyol (PLURONIC L-121) were reacted at a temperature of about 100° C. for approximately 3 hours to produce a maleamic acid ester. The maleamic acid ester was filtered and stripped of remaining solvent under vacuum, and identified by IR, NMR, and elemental analysis. Thereafter, 409.8 parts of a 50% active solution of xylene and the abovedescribed maleamic acid ester and 74.2 parts of a polyoxyalkylene diamine were reacted at a temperature of about 100° C. for approximately 2 hours to produce the final reaction product additive. The polyoxyalkylene diamine may be represented by the formula $$NH_2-\underset{\substack{|\\ CH_3}}{CH}CH_2-[O\underset{\substack{|\\ CH_3}}{CH}CH_2]_b-[OCH_2CH_2]_c-[OCH_2\underset{\substack{|\\ CH_3}}{CH}]_d-NH_2$$

where c had an approximate value of 45.5, and b+d had an approximate value of 3.5. The final reaction product was filtered and stripped of remaining solvent under vacuum, and identified by IR, NMR and elemental analysis.

EXAMPLE V 49 parts of maleic anhydride, 400 parts of xylene, and 2000 parts of a polyoxyalkylene polyol (PLURONIC L-121) are reacted at a temperature of about 100° C. for approximately 3 hours to produce a maleamic acid ester. Thereafter, 409.8 parts of a 50% active solution of xylene and the abovedescribed maleamic acid ester and 74.2 parts of a polyoxyalkylene diamine are reacted at a temperature of about 100° C. for approximately 2 hours to produce the final reaction product additive. The polyoxyalkylene diamine is of the formula $$\begin{array}{l} \overset{CH_2CH_3}{\overset{|}{NH_2CHCH_2}}-[O\overset{CH_2CH_3}{\overset{|}{CH}}CH_2]_a-[O\underset{\substack{|\\ CH_3}}{CH}CH_2]_b-[OCH_2CH_2]_c- \\ \qquad\qquad -[OCH_2\underset{\substack{|\\ CH_3}}{CH}]_d-[OCH_2\overset{CH_2CH_3}{\overset{|}{CH}}]_e-NH_2 \end{array}$$

where c has an approximate value of 40.5, b+d has an approximate value of 40.5, and a+e has an approximate value of 24.5.

The motor fuel composition of the instant invention comprises a major amount or a base motor fuel and 0.0005–5.0 weight percent, preferably 0.001–1.0 weight percent of the abovedescribed reaction product. Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. An example of a motor fuel composition of the instant invention is set forth in Example VI, below.

EXAMPLE VI

100 PTB of the reaction product set forth in Example I (i.e. 100 pounds of reaction product per 1000 barrels of gasoline, equivalent to about 0.01 weight percent of reaction product based on the weight of the fuel composition) is blended with a major amount of a base motor fuel (herein designated as Base Fuel A) which is a premium grade gasoline essentially unleaded (less than 0.05 g of tetraethyl lead per gallon), comprising a mixture of hydrocarbons boiling in the gasoline boiling range consisting of about 22% aromatic hydrocarbons, 11% olefinic carbons, and 67% paraffinic hydrocarbons, boiling in the range from about 90° F. to 450° F.

It has been demonstrated that a motor fuel composition comprising a minor amount of the reaction product composition of the instant invention is effective in minimizing and reducing gasoline internal combustion engine deposits. This is an improvement in the fuel performance which may reduce the incidence of engine knock. A motor fuel composition of the instant invention (Example VI) was tested by the Combustion Chamber Deposit Screening Test (CCDST). In this test, the deposit-forming tendencies of a gasoline are measured. The amount of deposit formation correlates well with the ORI performance observed in car tests and engine tests. The amount of deposit is compared to a high reference (a standard gasoline known to have a high deposit formation) and a low reference (an unleaded base fuel which is known to have a low deposit formation).

The CCDST determines whether the additive in question is effective as a deposit control additive to prevent ORI. In this test, the additive samples of the reaction product compositions to be tested were first dissolved in 3.0 wt. % methanol and thereafter dissolved in Base Fuel A in a concentration of 100 PTB (100 pounds of additive per 1000 barrels of fuel, equivalent to about 0.033 weight percent of additive). In a nitrogen/hot air environment the gasoline was then atomized and sprayed onto a heated aluminum tube. After 100 minutes, the deposits which were formed on the tube were weighed. Gasolines which form larger amounts of deposits on the heated aluminum tube cause the greatest ORI when employed in an internal combustion engine. The CCDST was also employed to measure the deposit tendencies of a high reference fuel (Example H), known to yield a large deposit, and a low reference fuel (Example L), a standard unleaded gasoline known to yield a low deposit. The results are summarized below:

| Sample Tested | CCDST Results (mg) Low Ref. | High Ref. | Sample Result |
|---|---|---|---|
| Base Fuel A + 100 PTB Example I | 3.0 | 9.1 | 3.6 |

The above results illustrate that a motor fuel composition of the instant invention (as illustrated by Example VI) was comparable to the low reference unleaded base fuel and greatly superior to the high reference standard fuel in terms of resistance to deposit formation, and consequently in terms of ORI-inhibition.

The efficacy of the reaction product of the instant invention as an ORI-controlling additive in motor fuel compositions has been demonstrated by subjecting the reaction products exemplified by Examples II, III, and IV, as well as two commercially available fuel additives (OGA-480 and OG-472, both available from Chevron Chemical Company) to Thermogravimetric Analysis (TGA). As discussed at Col. 12, lines 30–62 of U.S. Pat. No. 4,198,306 (Lewis), incorporated herein by reference, deposit control additives showing low TGA values, i.e. more rapid thermal decomposition, have been found to show low ORI values in laboratory engine tests. The results of the TGA tests are set forth below:

| Compound | TGA Test Results Weight Remaining (%) after 30 min. at 295° C. |
|---|---|
| OGA-480 | 3.3 |
| OGA-472 | 64.6 |
| Example II | 2.88 |
| Example III | 2.79 |
| Example IV | 8.5 |

It is well known to those skilled in the art that additive OGA-480 controls engine ORI but that OGA-472 tends to cause engine ORI. From the above TGA data, Examples II, III, and IV all yielded % TGA residue values comparable to OGA-480 but much less than OGA-472, and therefore should have corresponding ORI-controlling properties much greater than OGA-472 and comparable to OGA-480. Thus, reaction product additives of the instant invention (as exemplified by Examples II, III, and IV) have ORI-controlling properties comparable to a commercially available additive (OGA-480).

For convenience in shipping and handling, it is useful to prepare a concentrate of the reaction product of the instant invention. The concentrate may be prepared in a suitable liquid solvent such as toluene or xylene, with xylene being particularly preferred. In a preferred mode of preparing a concentrate of the instant invention, approximately 0.1–10.0, preferably 5.0–10.0 weight percent of the reaction product of the instant invention is blended with a major amount of liquid solvent, preferably xylene.

Motor fuel and concentrate compositions of the instant invention may additionally comprise any of the additives generally employed in motor fuel compositions. Thus, compositions of the instant invention may additionally contain conventional carburetor detergents, anti-knock compounds such as tetraethyl lead compounds, anti-icing additives, upper cylinder lubricating oils, and the like. In particular, such additional additives may include compounds such as polyolefin polymers, copolymers, or corresponding hydrogenerated polymers or copolymers of $C_2$–$C_6$ unsaturated hydrocarbons, or mixtures thereof. Additional additives may include substituted or unsubstituted monoamine or polyamine compounds such as alkyl amines, ether amines, and alkyl-alkylene amines or combinations thereof.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

The invention claimed is:

1. A motor fuel composition comprising a mixture of hydrocarbons boiling in the range from about 90°–450° F. and additionally comprising from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene polyol of the formula $$OH-(CH_2CH_2O)_x-(\underset{\underset{CH_3}{|}}{C}HCH_2O)_y-(CH_2CH_2O)_z-H$$

where x+z has a value in the range of 1–20, and y has a value in the range of 5–100; and (c) 5–1.5 moles of a nitrogen-containing compound selected from the group consisting of:

(i) a $C_2$–$C_8$ polyalkylene polyamine;

(ii) a polyoxyalkylene diamine of the formula $$NH_2-(R_2)_q-[O\overset{\overset{CH_2CH_3}{|}}{C}HCH_2]_a-[O\underset{\underset{CH_3}{|}}{C}HCH_2]_b-[OCH_2CH_2]_c-[OCH_2\underset{\underset{CH_3}{|}}{C}H]_d-[OCH_2\overset{\overset{CH_2CH_3}{|}}{C}H]_e-(R_3)_r-NH_2$$

where $R_2$ and $R_3$ are $C_1$–$C_{12}$ alkylene groups, q and r are integers having a value of 0 or 1, c has a value from 2–150, b+d has a value from 2–150, and a+e has a value from 0–12; and (iii) a heterocyclic azole.

2. A motor fuel composition according to claim 1, where said dibasic acid anhydride is maleic anhydride.

3. A motor fuel composition according to claim 1, where x+z has a value in the range of 2–16, and y has a value in the range of 10–90.

4. A motor fuel composition according to claim 3, where x+z has a value of about 2.2, and y has a value of about 14.7.

5. A motor fuel composition according to claim 3, where x+z has a value of about 11.9, and y has a value of about 21.1.

6. A motor fuel composition according to claim 3, where x+z has a value of about 8, and y has a value of about 24.1.

7. A motor fuel composition according to claim 3, where x+z has a value of about 5.5, and y has a value of about 16.6.

8. A motor fuel composition according to claim 3, where x+z has a value of about 15.9, and y has a value of about 18.1.

9. A motor fuel composition according to claim 3, where x+z has a value of about 10, and y has a value of about 90.

10. A motor fuel composition according to claim 1, where said $C_2$–$C_8$ polyalkylene polyamine is selected from the group consisting of ethylene diamine, diethylene triamine, and tetraethylene pentamine.

11. A motor fuel composition according to claim 1, where said polyoxyalkylene diamine is of the formula

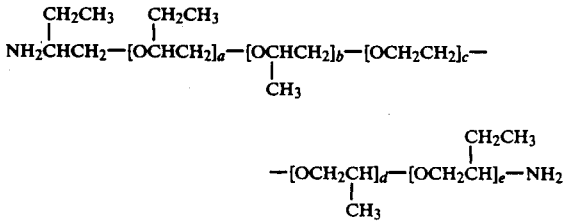

where c has a value from about 2–50, b+d has a value from about 2–50, and a+e has a value from about 2–8.

12. A composition according to claim 1, where said polyoxyalkylene diamine is of the formula

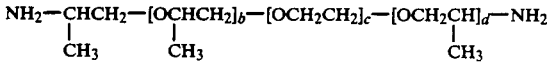

where c has a value of 2–50, and b+d has a value of 2–8.

13. A motor fuel composition according to claim 1, where said heterocyclic azole is an aminotriazole.

14. A motor fuel composition according to claim 13, where said aminotriazole is selected from the group consisting of 3-, 4- and 5-aminotriazole.

15. A motor fuel composition according to claim 1, where said heterocyclic azole is an aminotetrazole.

16. A motor fuel composition according to claim 15, where said aminotetrazole is selected from the group consisting of 4- and 5-aminotetrazole.

17. A motor fuel composition according to claim 1, where said heterocyclic azole is an aminomercaptothiadiazole.

18. A motor fuel composition according to claim 17, where said aminomercaptothiadiazole is a 5-aminomercaptothiadiazole.

19. A motor fuel composition according to claim 1, where said heterocyclic azole is a benzomercaptothiazole.

20. A motor fuel composition according to claim 1, where said heterocyclic azole is benzotriazole.

21. A motor fuel composition according to claim 1, where said heterocyclic azole is tolyltriazole.

22. A motor fuel composition comprising a mixture of hydrocarbons boiling in the range from about 90°–450° F. and additionally comprising from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene polyol of the formula

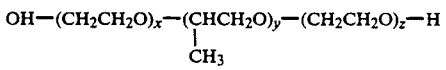

where x+z has a value in the range of 1–20, and y has a value in the range of 5–50; and (c) 0.5–1.5 moles of a $C_2$–$C_8$ polyalkylene polyamine selected from the group consisting of ethylene diamine, diethylene triamine, and tetraethylene pentamine.

23. A motor fuel composition comprising a mixture of hydrocarbons boiling in the range from about 90°–450° F. and additionally comprising from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene polyol of the formula

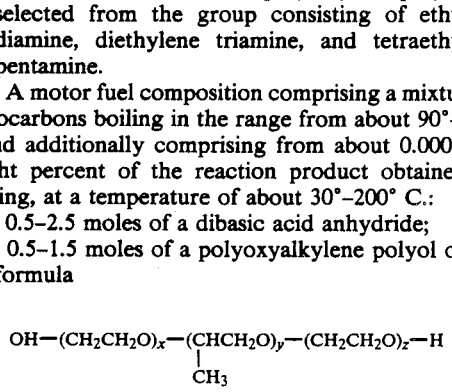

where x+z has a value in the range of 1–20, and y has a value in the range of 5–100; and (c) 0.5–1.5 moles of a polyoxyalkylene diamine of the formula

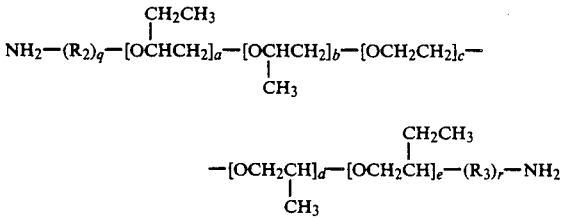

where $R_2$ and $R_3$ are $C_1$–$C_2$ alkylene groups, q and r are integers having a value of 0 or 1, c has a value from 2–150, b+d has a value from 2–150, and a+e has a value from 0–12.

24. A motor fuel composition comprising a mixture of hydrocarbons boiling in the range from about 90°–450° F. and additionally comprising from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene polyol of the formula

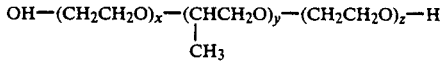

where x+z has a value in the range of 1–20, and y has a value in the range of 5–100; and (c) 0.5–1.5 moles of a heterocyclic azole.

25. A motor fuel composition according to any one of the preceding claims comprising from about 0.001–0.1 weight percent of said reaction product.

* * * * *